US007926403B1

(12) United States Patent
Vigil et al.

(10) Patent No.: US 7,926,403 B1
(45) Date of Patent: Apr. 19, 2011

(54) TRANSIENT, HIGH RATE, CLOSED SYSTEM CRYOGENIC INJECTION

(75) Inventors: Eric P. Vigil, Huntington, WV (US); David L. Kruczynski, Amissville, VA (US); Barry L. Landers, Point Pleasant, WV (US); Dennis W. Massey, Markham, VA (US)

(73) Assignee: Utron Inc., Manassas, VA (US)

( * ) Notice: Subject to any disclaimer, the term of this patent is extended or adjusted under 35 U.S.C. 154(b) by 963 days.

(21) Appl. No.: 11/824,308

(22) Filed: Jun. 29, 2007

Related U.S. Application Data

(60) Provisional application No. 60/817,620, filed on Jun. 29, 2006.

(51) Int. Cl.
*F41A 1/04* (2006.01)

(52) U.S. Cl. ..... 89/7; 89/1.1; 102/440; 239/398

(58) Field of Classification Search ..... 89/7, 1.1; 124/71, 72; 102/440, 443; 239/398, 68; 60/257, 258, 259, 260
See application file for complete search history.

(56) References Cited

U.S. PATENT DOCUMENTS

| | | | | |
|---|---|---|---|---|
| 3,044,363 | A * | 7/1962 | Musser | 89/8 |
| 3,496,827 | A * | 2/1970 | Dardlck | 89/8 |
| 3,601,061 | A * | 8/1971 | Dardick | 102/520 |
| 3,712,171 | A * | 1/1973 | Sweigart | 89/7 |
| 4,644,843 | A * | 2/1987 | Soper | 89/7 |
| 4,653,380 | A * | 3/1987 | Griffing et al. | 89/7 |
| 4,841,723 | A | 6/1989 | Lau | |
| 5,012,719 | A * | 5/1991 | Goldstein et al. | 89/8 |
| 5,052,272 | A * | 10/1991 | Lee | 89/7 |
| 5,303,633 | A * | 4/1994 | Guthrie et al. | 89/8 |
| 5,429,030 | A * | 7/1995 | Tidman | 89/7 |
| 5,542,606 | A * | 8/1996 | Kadyrov et al. | 239/81 |
| 5,899,388 | A | 5/1999 | Sion et al. | |
| 6,003,300 | A | 12/1999 | Bates | |
| 6,073,437 | A | 6/2000 | Jones | |
| 6,145,299 | A | 11/2000 | Fasano | |
| 6,205,770 | B1 | 3/2001 | Williams et al. | |
| 6,212,988 | B1 * | 4/2001 | Chernyshov et al. | 89/7 |
| 6,220,016 | B1 | 4/2001 | Delever et al. | |
| 6,260,802 | B1 * | 7/2001 | Hampsten | 244/137.1 |
| 6,517,010 | B1 * | 2/2003 | Barykin et al. | 239/79 |
| 6,663,350 | B2 | 12/2003 | Tyree, Jr. | |
| 6,679,155 | B1 * | 1/2004 | Yaschur et al. | 89/1.813 |
| 6,679,294 | B1 * | 1/2004 | Ringelberg et al. | 138/114 |
| 6,684,625 | B2 | 2/2004 | Kline et al. | |
| 6,708,905 | B2 | 3/2004 | Borissov et al. | |
| 6,783,824 | B2 | 8/2004 | Steffier et al. | |
| 7,254,914 | B2 * | 8/2007 | Lund et al. | 42/106 |
| 7,775,148 | B1 * | 8/2010 | McDermott | 89/8 |
| 7,784,268 | B1 * | 8/2010 | Greason et al. | 60/259 |
| 2002/0100361 | A1 * | 8/2002 | Russell | 89/14.5 |
| 2004/0026572 | A1 * | 2/2004 | Burton | 244/172 |
| 2006/0266206 | A1 * | 11/2006 | Lund et al. | 89/7 |
| 2008/0256924 | A1 * | 10/2008 | Pederson et al. | 60/245 |
| 2010/0212481 | A1 * | 8/2010 | Koth | 89/7 |

* cited by examiner

*Primary Examiner* — Benjamin P Lee
(74) *Attorney, Agent, or Firm* — James Creighton Wray

(57) ABSTRACT

The new injection system provides rapid, high pressure, high density, and transient batch injection of cryogenic liquids. The system stores and maintains the temperature of liquids in vacuum jacketed tanks, increases pressures using pumps, and stores the high pressure fluid in accumulators. The accumulator periodically injects the fluids at high pressure in measured mass batches into a combustion chamber. The system injects enough liquid or gas in 0.5 to 3.0 seconds to provide 500 to 6500 psi in a closed chamber.

17 Claims, 11 Drawing Sheets

LINE CONFIGURATION

A 1.5" SS PIPE, VACUUM JACKETED

B 3/4" SS TUBE, ID = 1/2", VACUUM JACKETED

C 1/2" SS TUBE, ID = 1/2", NOT INSULATED

D 1/2" SS PIPE, 2" INSULATION, FOAMGLAS
HEAT FLOW = 0.29 BTU/HR * IN/ FT2

E 1.5" SS TUBE, NOT INSULATED

F 3/4" SS FLEXIBLE TUBE, 1/2" ID
14,000 PSI BURST, 1.0" INSULATION
CERAMIC BLANKET
HEAT FLOW = 0.27 BTU/HR * IN/ FT2

G 3/8" NYLON TUBE, NOT INSULATED

H 1/2" SS SAE 45° FLARE FITTING, ID = 1/2", 3/4 OD

J 1" SS PIPE, VACUUM JACKETED

K 1/2" PIPE, 2" INSULATION, CERAMIC BLANKET
HEAT FLOW = 0.27 BTU/HR * IN/ FT2

L 1.25" SS TUBE, 1.0" ID, 2" INSULATION, CERAMIC BLANKET
HEAT FLOW = .27 BTU/HR * IN/ FT2

M 2" SS TUBE, 1.75" ID, NOT INSULATED

N 1.25" SS TUBE, 1.0" ID, NOT INSULATED

P 1" SS TUBE, 7/16" ID, HM16
2" INSULATION
HEAT FLOW = 0.29 BTU/HR * IN/ FT2

Q 3/4" SS TUBE, 2" INSULATION
HEAT FLOW = 0.29 BTU/HR * IN/ FT2

R 1/2" TEFLON (FEP), 0.060 WALL, NOT INSULATED

S 1/4" NYLON TUBE, NOT INSULATED

T 1/4" SS TUBE, 1/16" ID, FX4, NOT INSULATED

U 1.25" TUBE, 1.0" ID, 4" INSULATION
HEAT FLOW = 0.29 BTU/HR * IN/ FT2

Figure 9

TRANSIENT, HIGH RATE, CLOSED SYSTEM CRYOGENIC INJECTION

This application claims the benefit of U.S. Provisional Application No. 60/817,620 filed Jun. 29, 2006, which is hereby incorporated by reference in its entirety.

FIELD OF THE INVENTION

The present invention provides high pressure, large volume, high density, transient, batch injection of cryogenic liquid or gas into a relatively small, closed chamber for rapidly cycling combustion such as occurs in a gas gun or other combustion driven devices such as switches, presses, etc.

BACKGROUND OF THE INVENTION

Gas guns generally have low rates of fire because of the long periods of time required to fill the combustion chamber with the necessary gases unless expensive and leakage-prone gas filled cartridges are used. Light gas guns in particular can provide very high muzzle velocities but cannot presently load propellants quickly enough to achieve the high rates of fire required by an effective weapon. The friction and compression heating caused by extremely rapid transfer of room temperature gases results in high temperatures that especially impede injection of the necessary quantity of propellants into relatively small volume, closed combustion chambers. Combustion driven presses for powdered metal parts and other production as well as very fast and reliable combustion driven switches have similar cycling limitations with present injection methods.

Liquid fuel rocket engines generally employ turbomachinery for pressurizing and/or gasifying the liquid propellants prior to injection into the main rocket nozzle. Furthermore, one or more of the propellant components may be adapted to cool the main rocket nozzle and heat the cryogenic propellant through associated plumbing circuitry. Liquid fuel and liquid oxidizer are provided from pressurized tanks at relatively low-pressure to separate sections within a rotor system driven by a relatively low-pressure ratio turbine that is powered by combustion effluent generated by a precombustor. A rocket engine frequently uses primary and secondary rotary injectors for injecting fuel and oxidizer propellant components into a first combustion chamber, and the effluent drives a turbine that rotates the rotary injectors. The mixture within the first combustion chamber is preferably fuel-rich so as to reduce the associated combustion temperature, and the fuel-rich effluent mixes in a second combustion chamber with additional oxidizer injected by a third rotary injector so as to generate a high temperature effluent suitable for propulsion. The rotary injectors are adapted to isolate the low-pressure propellant supply from the relatively high pressures in the respective combustion chambers. Rocket engines use steady state injection into open combustion chambers with much lower injection and combustion pressures than either gas gun or combustion driven applications.

A considerable amount of heat is transferred in all designs of rocket engines. The principle objective of high-temperature rocket design is to safely limit the heat transfer to the materials in critical hot sections such as the injector, combustion chamber, throat, and nozzle. The walls have to be cooled sufficiently to not exceed their safe allowable operating limit. Erosion, usually the result of combined oxidation and chemical interaction with the hot combustion gases, should not damage the walls, and the walls should be capable of withstanding the extreme thermal shock caused by the sudden onset of a high heat flux from combustion ignition. The materials comprising the thrust chamber devices must also be capable of resisting the thermal stresses induced by the heat transfer and thermal gradients.

Actively-cooled liquid propellant thrust chambers have provisions for cooling some or all of the components in contact with the hot combustion gases, such as the chamber walls, nozzle walls and injector faces. A cooling jacket or cooling coil often consists of separate inner and outer walls or a bundled assembly of continuous, contoured tubes. The inner wall confines the combustion gases, and the space between the inner and outer walls serves as the coolant passage. Regenerative cooling is a form of active cooling and is used for engines where one of the propellant constituents is circulated through cooling passages around the thrust chamber prior to injection and burning of the propellant in the combustion chamber. Regenerative cooling in bipropellant engines uses either the fuel or oxidizer as the cooling fluid. Therefore, the thermal energy absorbed by the coolant is not wasted as it augments the initial energy content of the propellant prior to injection, thereby increasing the exhaust velocity and propulsive performance. Radiation cooling is typically used in monopropellant thrust chambers, some gas generators and for nozzle exhaust sections. Radiation cooling is a simple, lightweight cooling method, which is commonly employed in low-temperature rocket engines, such as hydrazine (monopropellant) spacecraft maneuver and attitude control systems, where the maximum chamber temperature is only about 650 degrees C.

The fundamental principle that allows a hybrid rocket to burn is that in steady state operation, the fuel surface is constantly generating a melt layer, which in turn generates vapor as more heat is added or the heat causes the fuel to sublime directly to vapor from solid phase. The method of improving combustion of a hybrid rocket by gasifying liquid oxygen (LOX) as it enters the hybrid motor, before it contacts the hybrid fuel, is comprised of connecting at least one $O_2$-driven hybrid heater to the motor such that its exhaust stream intersects and mixes directly with the LOX stream. Gaseous oxygen (GOX) is provided to the hybrid heater during the entire burn of the rocket. The hybrid heater is preferably ignited with electrical current.

Liquid injection of fuel into supersonic combustors has experienced difficulty in achieving vaporization of the liquid droplets, followed by gas mixing of this vapor with the surrounding air so that complete, molecular-scale mixing and combustion can take place inside the combustor. If the fuel droplets are small enough to vaporize quickly, they are carried along with the flow and because there is little relative velocity between the vaporizing droplet and the surrounding flow, there is no driving force for mixing the air with the vapor fuel except by molecular diffusion, which is very slow compared with fluid dynamic mixing. If the fuel droplets are large and a relative velocity can be maintained with respect to the surrounding air to promote mixing, a large amount of heat is required to vaporize the droplets and fuel vapor is formed at a relatively slow rate compared with the same mass of fuel dispersed in smaller droplets. Thus for either large or small liquid droplets of fuel the final mixing of fuel and air on a molecular scale necessary for combustion is a slow process compared with the approximately 10 ms time scale to flow through a supersonic combustor.

A high-pressure pump and delivery system provides a method of utilizing both pumped LNG and compressed NG in a Diesel type fuel injection system. As the truck's engine requires fuel, the LNG is vaporized and supplied to the engine at a pre-determined pressure, with the desired pressure being a function of the engine's specific design. These engines are generally designed to operate at pressures between 200 psig and 2,000 psig with potential for as much as 3000 psig.

There is a need in the art for an improved, high rate transient closed-system cryogenic injection system.

SUMMARY OF THE INVENTION

The present invention provides more rapid, higher-pressure, higher density, transient, and batch injection of cryogenic liquid or gas as compared to prior art. In 0.5 to 3.0 seconds, this invention injects enough gas to provide 500 to 6500 psi pressure in a closed combustion chamber. In contrast to prior art, this invention provides steady state injection or transient injection. Prior art typically uses injection pressures ranging from 200 to 2000 psi with potential up to 3000 psi. This invention injects cryogenic liquids or gases at 500 to 6500 psi with potential for much higher pressures as cycle rates increase.

A cryogenic-high-pressure-propellant-feed system injects oxygen and hydrogen into a gun chamber. The cryogenic-high-pressure-propellant-feed system is able to fire the gun every 6 seconds and has liquid storage of the oxygen and hydrogen.

The primary objectives of the high-pressure-propellant-feed-system are to fill the combustion chamber in two seconds, have liquid propellant storage, propel a projectile mass of 0.20 kg to 0.52 kg and at a velocity of 1500 m/s to 3200 m/s, and have the chamber, ignition system, and barrel survive numerous firings. The secondary objectives of the high-pressure-propellant-feed-system are to provide sufficient supply line flow, leak test all plumbing and tanks, control mass flow rate, have 100% liquid in the pump's sump, system automation, and intrinsic and extrinsic safety.

Although hydrogen is a fire hazard, it is not to the level of gasoline or acetylene. Liquid oxygen and hydrogen hazards are asphyxiation, extreme cold, and fire. Each of these risks can be mitigated by following proper design guidelines and procedures.

The system provides specific propellants to use, propellant storage methods, combustion chamber injection methods, phases of the propellant at ignition, chamber injection rates, and mass of propellants to use. In propellant selection, hydrogen and oxygen were chosen as propellants because of their superior heat of reaction and low molecular weight exhaust mass.

Cryogenic liquid storage of the propellants is the best storage method because of the significant space savings. Liquid storage is 1/840 the volume of gas at ambient conditions for hydrogen, 1/700 the volume of gas at ambient conditions for oxygen, 1/6 the volume of hydrogen gas in a cylinder at 2200 psi, and 1/5 the volume of oxygen gas in a cylinder at 2200 psi. Cryogenic liquid storage has become very common in commercial industries, for example: liquid oxygen for fish stocking aeration and liquid carbon dioxide for beverages. Liquid hydrogen and liquid oxygen are purchased at typical commercial conditions, approximately 35 psi at −414° F. for liquid hydrogen and 230 psi at −227° F. for liquid oxygen.

The chamber injection method uses a high-pressure accumulator between the pump and combustion chamber. The accumulator has passive heat exchanger cooling, exchanging heat with ambient pressure liquid nitrogen. The accumulator has the following benefits: flow smoothing/steadiness, consistent supply from accumulator to chamber, ability to use a smaller, less expensive pump, and modularization of pump and test chamber.

In phase selection, "G" means gaseous, "L" means liquid, "OX" oxygen, "$H_2$" hydrogen, and "$N_2$" nitrogen. The pumps pump 100% liquid. The oxygen accumulator stores GOX. The hydrogen accumulator stores GH2 at −319° F. The −319° F. is achieved by cooling the accumulator with $LN_2$. The GOX and $GH_2$ flow into the combustion chamber. There is sufficient heat transfer from the metal of the supply lines that oxygen phase changes to gas before reaching the accumulator. The result at ignition is GOX+$GH_2$.

The cryogenic-propellant-feed system is able to fire the gun every 6 to 10 seconds and uses liquid storage of the oxygen and hydrogen. This system stores $LH_2$ in a Prentex 500 gallon fixed tank and LOX in Air Gas dewars. It obeys NFPA (National Fire Protection Agency) guidelines and OSHA law. PHPK vacuum jacketed tubing is used for the $LH_2$ supply line to the pump. Swagelok tubing insulated with cellular glass is used for the LOX supply line to the pump. Cryostar pumps fill an 18 liter LOX accumulator and an 18 liter $GH_2$ accumulator, built by Vulcan and Prentex. The accumulators are filled up to 8000 psi and can be $LN_2$ cooled to maintain long-term storage. After the accumulator, the GOX or $GH_2$ is reduced from 8000 psi to 500 to 6500 psi. The gas flows through a mass flow meter by Micromotion and Utron Inc.'s poppet valve to fill the gun chamber. The gun chamber is filled from the accumulator in 0.5 to 3 seconds.

The 500 gallon $LH_2$ tank has a 2" OD low-pressure vent and a 1.25" OD high-pressure vent. The oxygen tank has a 1.25" OD oxygen supply line, a 1.25" OD low-pressure vent, and a 1.25" OD high-pressure vent.

A $GN_2$ supply is used to actuate all pneumatic valves (at 15 psi, 30 psi, 90 psi, and 250 psi) and to provide purging. For the system to be intrinsically safe, all the supply valves are normally closed and all the vent valves are normally open. In the event of power failure or disruption of the nitrogen supply, the supply line valves will close and the vent valves will open. A solenoid bank controls the nitrogen supply to each pneumatic valve.

The system includes tanks, pumps, accumulators, mass control system (mass flow meters and regulators), and a chamber. The LOX and $LH_2$ reciprocating pumps require 100% liquid at all times during operation.

Both accumulators hold up to 8000 psi. The accumulator outer jackets are $LN_2$ cooled. The jackets are open to the atmosphere and are vented. The hydrogen accumulator stores $GH_2$ at 8000 psi at −319° F. that is reduced to 5000 psi by the pressure-reducing regulator before passing through the hydrogen mass flow meter and into the chamber. The oxygen accumulator stores LOX at 6000 psi at −319° F. that passes through the oxygen mass flow meter and into the chamber. The mass flow meters are connected to the test chamber by flexible lines that allow for recoil. The final valve that is mounted on the gun chamber is designed to survive the 80,000 psi combustion in the chamber.

These and further and other objects and features of the invention are apparent in the disclosure, which includes the above and ongoing written specification, with the drawings.

BRIEF DESCRIPTION OF THE DRAWINGS

FIG. 9 is a legend showing the line configuration for the system in FIGS. 4-8.

DETAILED DESCRIPTION OF THE DRAWINGS

Figure 1:
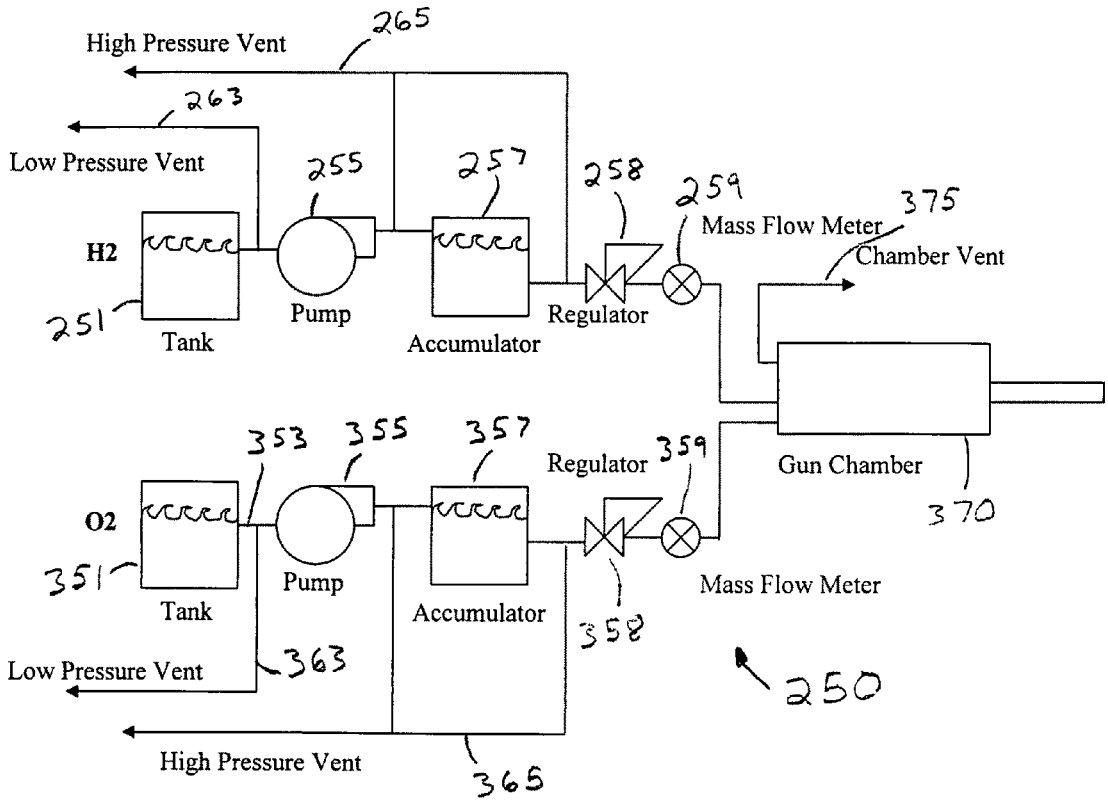
FIG. 1 is a schematic of the new system.

FIG. 1 is a schematic of the new system. This system 250 stores $LH_2$ in a Prentex 500 gallon fixed tank 251 and LOX in Air Gas dewars 351. PHPK vacuum jacketed tubing is used for the $LH_2$ supply line 253 to the pump 255. Swagelok tubing insulated with cellular glass is used for the LOX supply line 353 to the pump 355. Cryostar pumps 355, 255 fill an 18 liter LOX accumulator 357 and an 18 liter $GH_2$ accumulator 257, built by Vulcan and Prentex. The accumulators can be filled to 8000 psi and are $LN_2$ cooled to maintain long-term storage. After the accumulators, the GOX and $GH_2$ are reduced to 500 to 6500 psi. The GH2 flows through a pressure regulator 261 and the GOX and GH2 flow through a mass flow meter 359, 259 by Micromotion and Utron Inc.'s poppet valve to fill the chamber 370. The gun chamber is filled from the accumulator in 0.5 to 3.0 seconds. A low-pressure hydrogen vent 263 is provided on line 253. A low pressure oxygen vent 363 is provided on line 353. A high-pressure hydrogen vent 265 is connected on both sides of the hydrogen gas accumulator 257. A high-pressure oxygen vent 365 is connected to both sides of the liquid oxygen accumulator 357. A chamber vent 375 is connected to the chamber 370.

Figure 2:
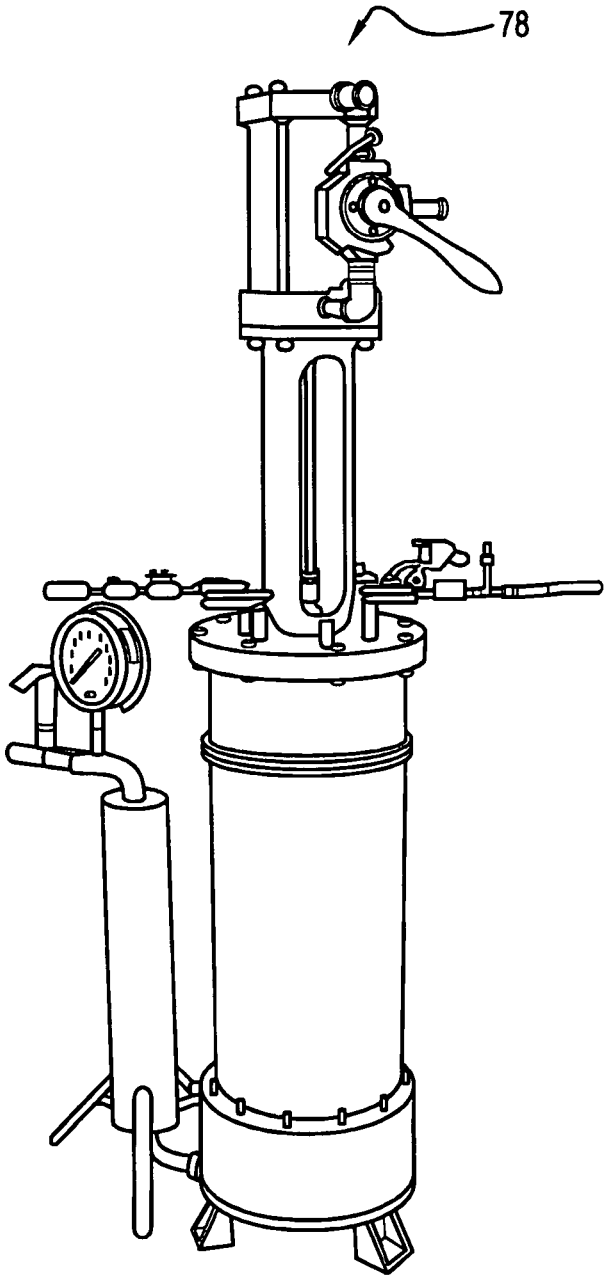
FIG. 2 is a photograph of a cryogenic oxygen pulse pump.

FIG. 2 shows the test setup used to conduct preliminary tests, using an oxygen pulse pump to inject liquid nitrogen into a receiver.

Below is a set of equations and a table with examples of the heat transfer and evaporation calculations used to examine the graph of test results in FIG. 3. Variable definitions: q=heat flow, L=length of chamber, deltaT=temperature difference between cryogen and chamber wall, $r_a$=liner inside radius, $r_b$=liner outside radius, $r_c$=chamber inside radius, $r_d$=chamber outside radius, $k_{liner}$=conduction coefficient of liner, $k_{chamb}$=conduction coefficient of chamber main wall.

No Liner $$q = \frac{2\pi k_{cham} L\Delta T}{\ln\left(\frac{r_d}{r_c}\right)}$$

With Liner $$q = \frac{2\pi L\Delta T}{\frac{\ln\frac{r_a}{r_b}}{k_{liner}} + \frac{\ln\frac{r_c}{r_b}}{k_{cham}}}$$

| Liner | Mixture | Component | Heat transfer (kW) | Mass loss (kg/s) | Component mass (kg) | Evaporation Time (s) |
|---|---|---|---|---|---|---|
| No | $6.2H_2 + O_2$ | $H_2$ | 61.4 | 0.138 | 0.103316 | 0.75 |
| | | $O_2$ | 46.1 | 0.216 | 0.264498 | 1.22 |
| | | | | Serial evaporation time | | 1.97 |
| Yes | $6.2H_2 + O_2$ | $H_2$ | 50.9 | 0.114 | 0.103316 | 0.91 |
| | | $O_2$ | 38.2 | 0.180 | 0.264498 | 1.47 |
| | | | | Serial evaporation time | | 2.38 |

Figure 3:
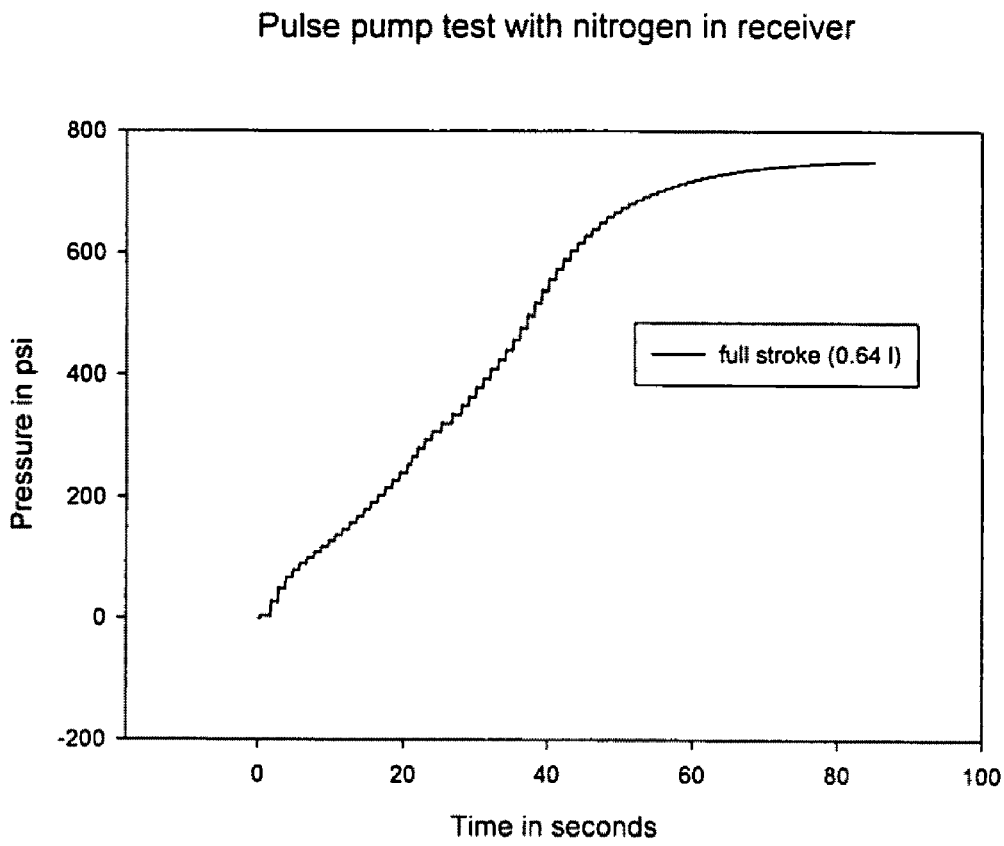
FIG. 3 is a graph of the results of a pulse pump injection test.

FIG. 3 shows the results of the preliminary pulse pump injection testing. The gun combustion chamber has about 2 to 3 times the effective surface area of the receiver. Minimum GOX requirements are less than half of those in the FIG. 3 pulse pump injection test (0.275 1), which could reduce the time to about 10 seconds for the preliminary pulse pump.

Figure 4:
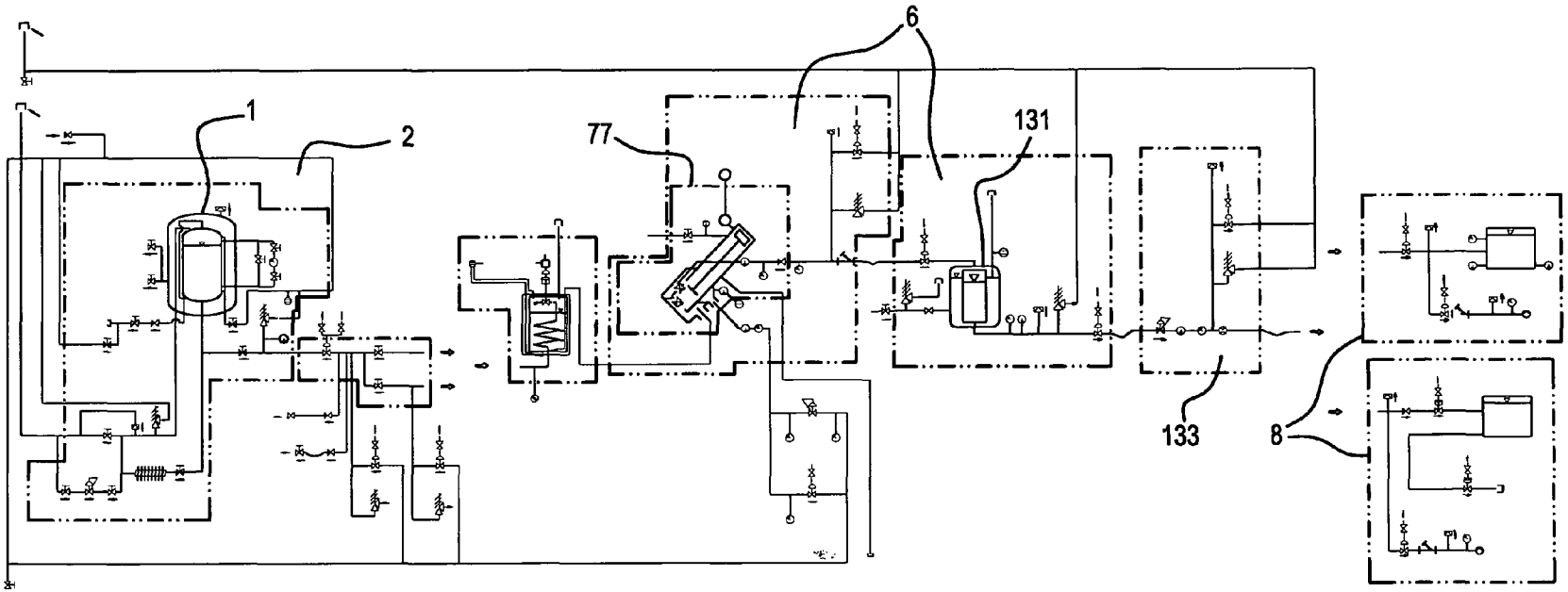
FIG. 4 is a schematic diagram for an example hydrogen injection system for a light gas gun.

FIG. 4 illustrates a light gas gun hydrogen injection system that feeds liquid hydrogen from a tank 1, through a subcooler assembly 79 to a pump 77 that charges an accumulator 131 to a pressure as high as 8000 psi, through a pressure reducing regulator 157 (500 to 6500 psi), through a mass flow meter 133 and into a closed chamber 8. Large lines reduce the pressure drop from high transient flow rates to minimize injection time for a high cycling rate. The subsystems of the injection system are shown close up in FIGS. 5-7.

Figure 5:
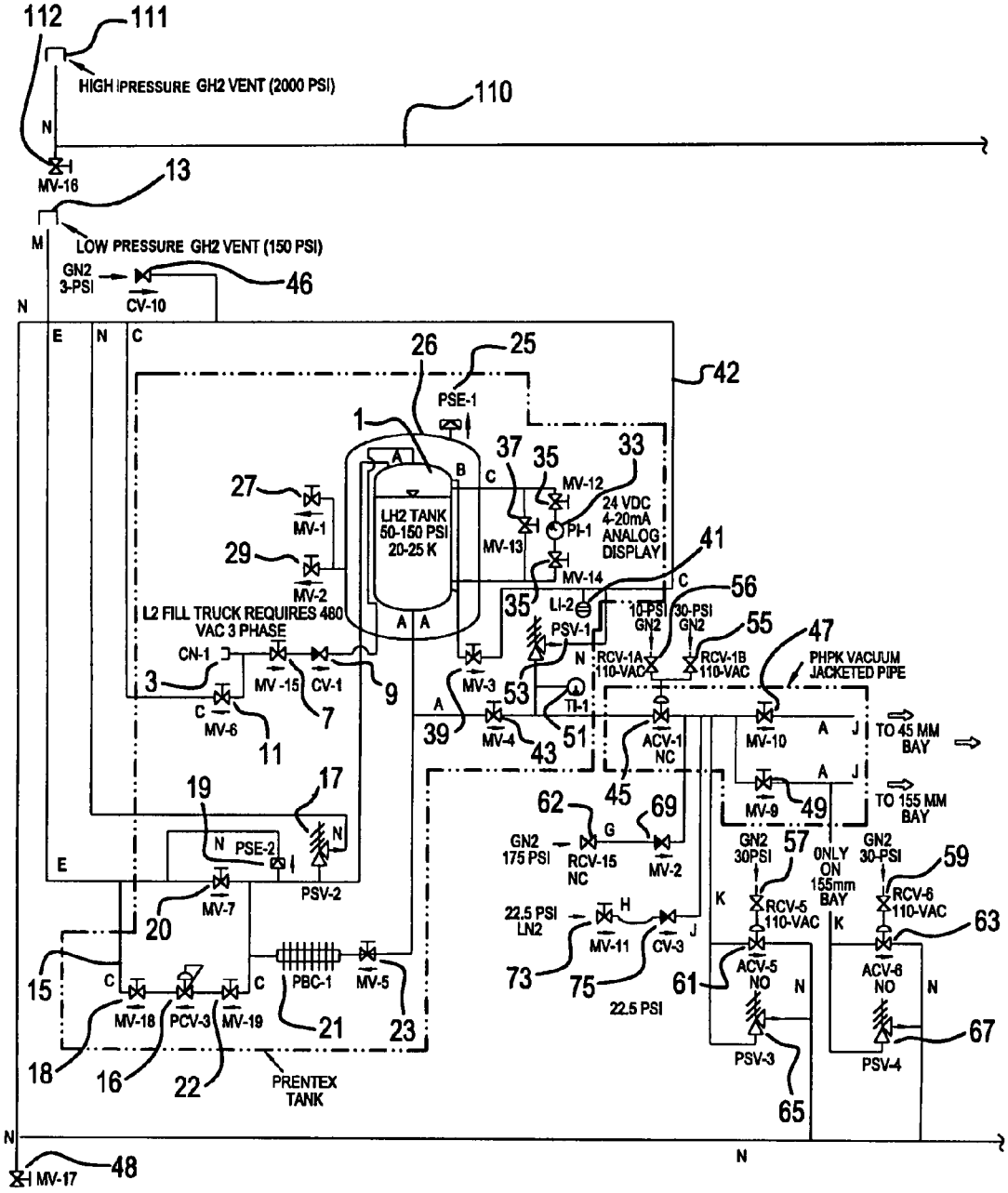
FIG. 5 is a schematic diagram of a liquid hydrogen tank subsystem.

FIG. 5 shows an enlarged view of the hydrogen tank subsystem. The tank of liquid hydrogen 1 is filled from the fill connection 3 through the fill line 5. The fill line shutoff valve 7 opens to allow hydrogen flow toward tank 1 and can cut off the flow from the fill line 5 to prevent over-filling. The fill line check valve 9 prevents reverse flow through the fill line 5 before it enters the tank 1. The fill line drain valve 11 allows gaseous hydrogen from the fill line to exit via the low pressure gaseous hydrogen vent 13.

The tank 1 has a pressure-building line 15 that ensures that the tank 1 remains sufficiently pressurized to flow the hydrogen the tank contains in liquid form and to force the hydrogen from the tank through the lines into the accumulator subsystem 6. A variety of devices on the line prevents the system from becoming over-pressurized and failing. A pressure relief device 17 reduces over pressure in the line 15 when the pressure becomes excessive. A rupture disk 19 vents gas in the event of excessive pressure build-up to prevent catastrophic failure of the tank 1 or line 15. A tank blowdown valve 20 allows gas to exit the system via the low pressure vent 13. A pressure building coil 21 warms the hydrogen and increases the pressure in the line 15 and tank 1 by heating the flow through the line 15. A back pressure regulator 16, isolated by valves 18, 22 on either side, controls the pressure on the line. An isolation valve 23 closes off the pressure building line 15 and isolates it from the tank 1, preventing pressure building.

For safety, a nitrogen purge 25 is provided to a vent stack 26 of the tank to remove the air from the vent before flowing liquid hydrogen from the tank. A vacuum probe isolation valve 27 releases pressure in the jacket 26. A vacuum pumpout valve 29 connects to a pump which creates or maintains a vacuum 31 in the space between the tank 1 and the outer tank 26. A pressure differential meter is a liquid hydrogen level indicator 33 and can be isolated from the rest of the system 2 by closing level indicator isolation valves 35 and opening the level indicator bypass valve 37.

A trycock valve 39 acts as a full indicator, and trycock level meter 41 indicates liquid level. The vent line 42 for the tank also has a purge isolation check valve 46 and vent water drain line 48. A tank discharge valve 43 flows liquid hydrogen from the tank 1 to the NC primary pump supply valve 45 and the 45 mm and 155 mm bays, which can be isolated from the tank subsystem 2 by a 155 mm bay isolation valve 47 and 45 mm bay isolation valve 49. A temperature sensor 51 in tank 1 monitors temperature in the pressure relief line after the flow through the tank discharge valve 43, and before pressure relief device 53. A throttling valve 45 pneumatically controlled by solenoids 55 and 56 controls flow out of the tank. Gaseous nitrogen at 30 psi is admitted by solenoids 57, 59 to control shut-off valves 61, and 63 which control hydrogen flow. Pressure relief devices 65, 67 act to release excess pressure in the lines.

A gaseous nitrogen purge of the entire supply line is provided by solenoid 62 through isolation check valve 69 when the system is shut down. Flow proceeds towards the 155 mm and 45 mm bays through valves 49 and 47 respectively. Valves 45, 47, and 49 are enclosed in a vacuum jacketed pipe 40.

Figure 6:
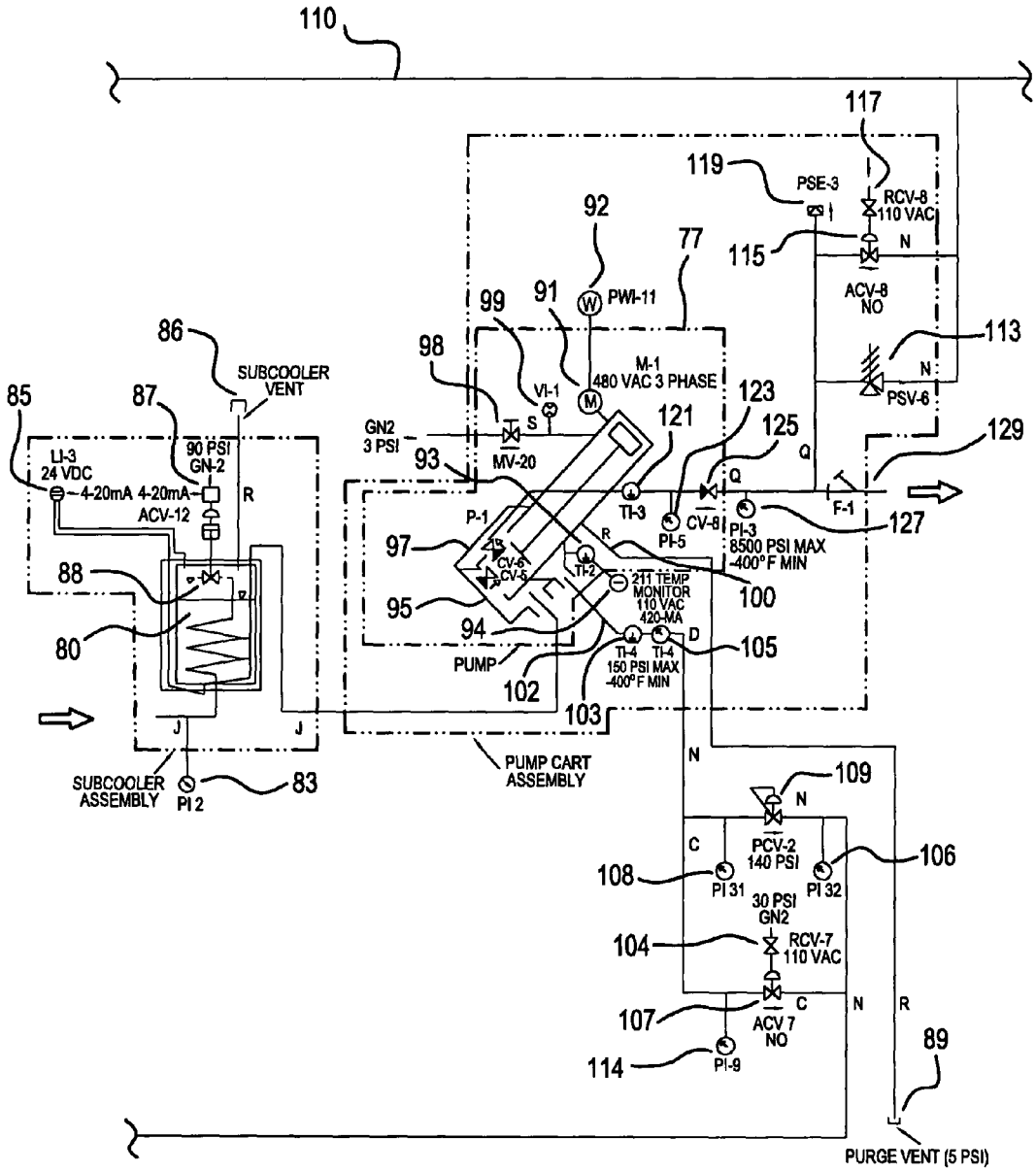
FIG. 6 is a schematic diagram of a subcooler and pump.

FIG. 6 is an expanded schematic of a portion of the subcooler 79 and pump 77. The pump is in a pump cart assembly enclosure 81. The flow passes through the subcooler 79, which reduces the temperature of the flow. The subcooler 79 operates by the use of a heat exchanger 82. A pressure sensor 83 before the pump subcooler 79 and pump 77 measures the pressure of the hydrogen flow as in enters the pump subsystem 6. The flow then passes through the subcooler assembly 79, which reduces the temperature of the flow. Inside the subcooler 79 is a pressure differential meter that acts as a level meter 85 that measures the level of liquid hydrogen in the subcooler bath 80, which is near atmospheric pressure, about 10 psi because of its vent 86. The flow to the atmospheric pressure bath is a bleed off the main line that comes from valve 87. The main line is then cooled by the lower pressure, thus lower temperature bath. The valve 87 cooperates with the subcooler level meter 85 to operate a NC subcooler low pressure/temperature supply valve 88 that flows hydrogen into the subcooler bath at low pressure and temperature.

The flow goes from the subcooler 79 to the pump 77. The pump crankcase is purged with nitrogen 98, which is then vented 89. The pump 77 is driven by a motor 91 that is monitored by a power meter 92. A silicon diode 93 in the pump sump monitors temperature and is connected to a temperature monitor 94. A pump suction check valve 95 and pump discharge check valve 97 enable flow through the pump. Gas enters the pump through a flow meter 99 and is vented through line 100.

Hydrogen also exits the pump 77 from the tank 1 through pressure relief device 101 in line 102. The pump sump has a vapor discharge line 102, which is wide open during prechilling of the pump per a pneumatically controlled valve 107 and during pump operation the vapor discharge line is vented through a back pressure regulator 109 set to the LH2 tank's pressure. Pressure gauges 106, 108 on either side of regulator 109 and pressure gauge 114 before valve 107 monitor the pressure in the line. A pre-chill line temperature sensor 103 and pressure sensor 105 measure the temperature and pressure of the flow. A high-pressure vent line 110 vents at the nozzle 111 (FIG. 5) and has a water drain valve 112. If over-pressurization occurs, a 9000 psi pressure relief device 113 or rupture disk 119 relieves pressure, or a normally open vent control valve 115 (opened by solenoid 117) can be opened by the operator.

After leaving the pump, the flow passes through a temperature sensor 121 and pressure gauge 123 and a liquid nitrogen isolation check valve 125. The flow passes by a pressure sensor 127 and filter 129 on its way to the accumulator 131 (FIG. 7).

Figure 7:
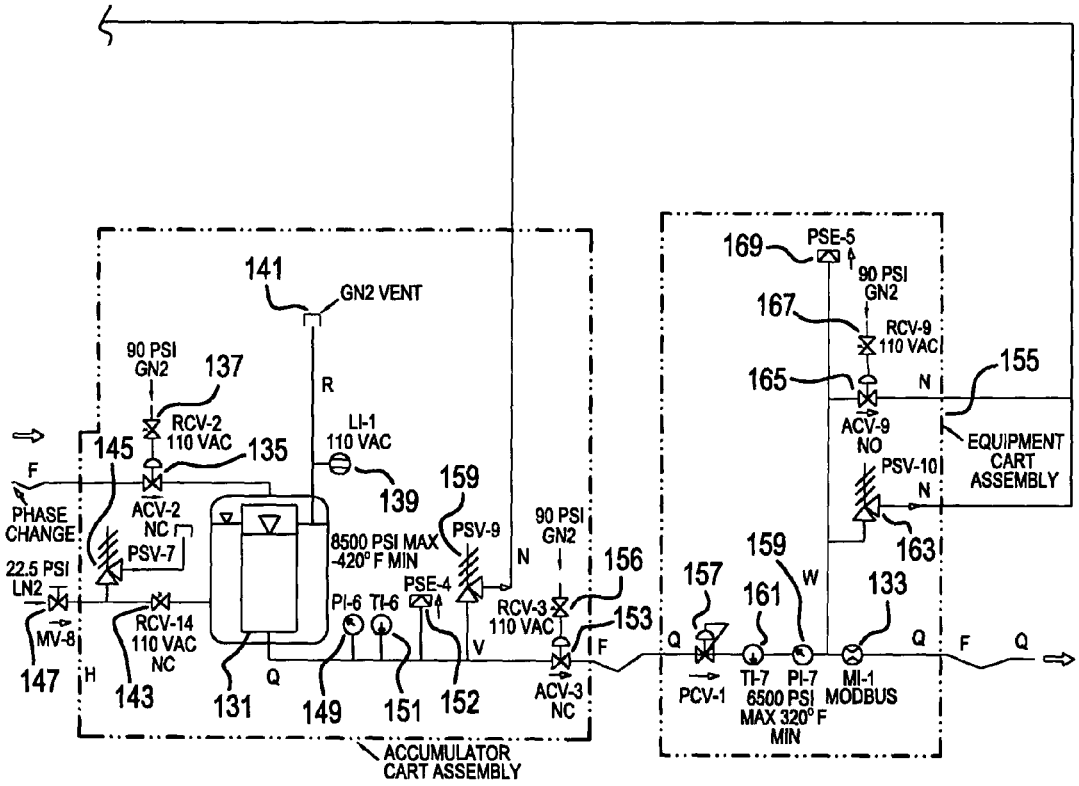
FIG. 7 is a schematic diagram of an accumulator, regulator, and mass flow meter.

FIG. 7 is an expanded schematic of a portion of the accumulator 131, pressure reducing regulator 157, and mass flow meter 133. The flow collects in the accumulator 131, which has an outer jacket that contains liquid nitrogen that enters through a dewar valve 147 to cool its contents. The level of liquid nitrogen in the jacket is maintained by a level meter 139 and is supplied by a liquid nitrogen dewar 147 through a solenoid 143. Gas from the liquid nitrogen jacket of the accumulator is vented 141. If that liquid entry line becomes over-pressurized, the pressure relief device 145 allows some venting and reduces the pressure on the line.

The accumulator 131 discharges hydrogen that passes though a pressure sensor 149 and temperature sensor 151 from the accumulator before entering the NC tertiary supply valve 153 from the accumulator outlet. The NC tertiary supply valve 153 is controlled by 90 psi gas when solenoid valve 156 is open. A rupture disk 152 allows venting if the system becomes over-pressurized and excess gas is released via a pressure relief device 154 through the high pressure gaseous hydrogen conduit 110 and vent 111.

Figure 8:
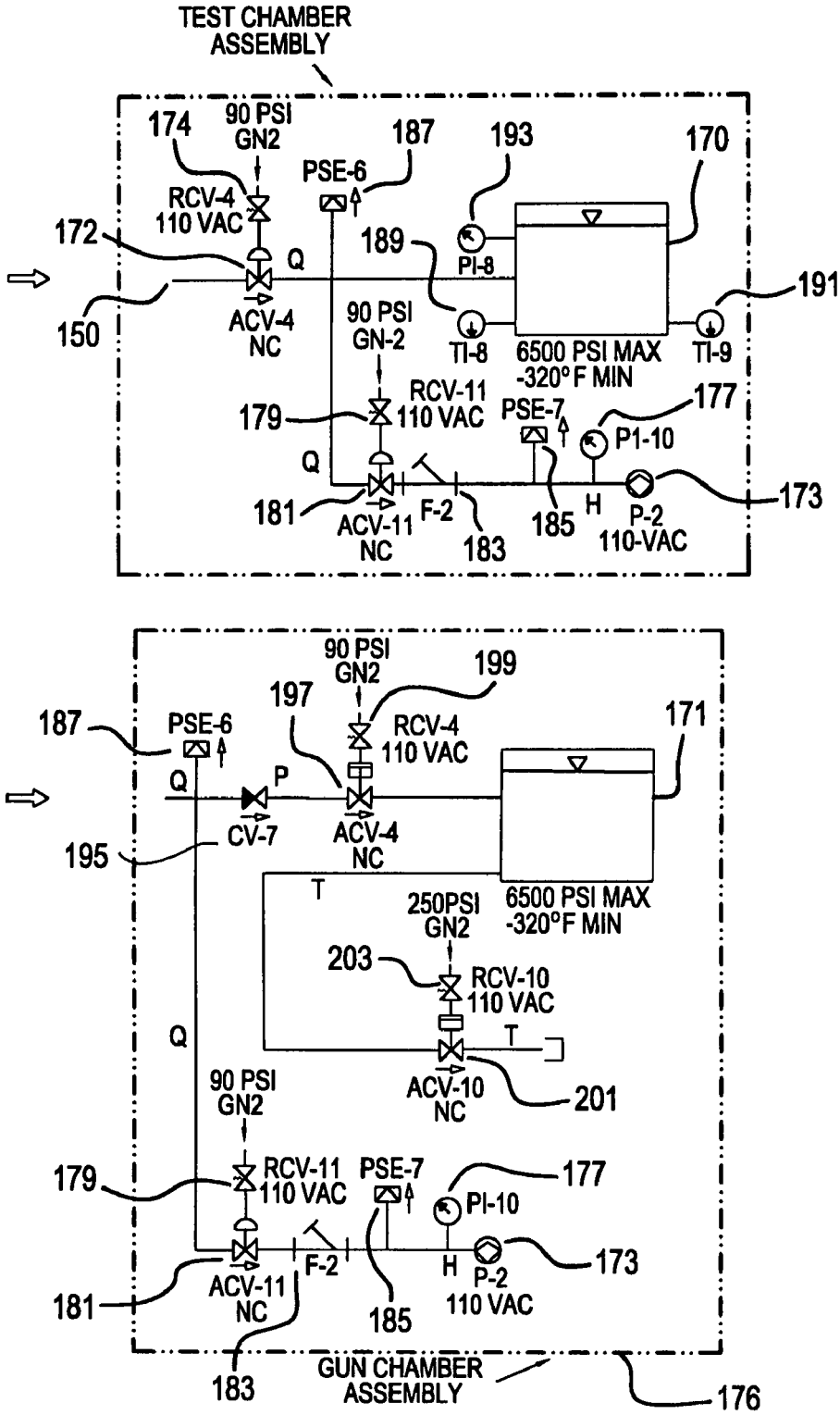
FIG. 8 is a schematic diagram of closed combustion chambers.

From the accumulator 131, the flow enters a pressure-reducing regulator 157, which reduces the pressure to 500 to 6500 psi. The fluid at this location is monitored by a pressure sensor 159 and temperature sensor 161. The flow then enters the mass flow meter 133 that measures the flow through the line into a closed chamber 8 (FIG. 8). The mass flow meter 133 allows precise control of the amount of high-pressure hydrogen provided by the accumulator for injection into the closed chamber. Typically, this system is used as a batching process, but can be used as a steady process. If over-pressurization occurs a pressure relief valve 163 or rupture disk 169 relieve pressure, or a normally open vent control valve 165 (opened by solenoid 167) can be opened by the operator.

Batches of measured hydrogen are injected from the accumulator 131 through an inlet 150 or 160 into a closed light gas combustion chamber, test chamber 170, or light gas gun combustion chamber 171 shown in FIG. 8. When the desired mass is measured by the mass flow meter a valve 172 or 197 controlled by a solenoid 174 or 199 (FIG. 8) is closed.

The oxygen injection system is similar to the hydrogen system shown in FIGS. 4-7.

FIG. 8 shows the closed chamber 170 or 171. For supply line drying and for removal of air from the supply line a vacuum pump 173 is used prior to running the system. Vacuum pump pressure gauges 177 check the draw down pressure in the lines. The line to the vacuum pump 173 is isolated by a valve 181 which is controlled by solenoid 179. Filter 183 is provided in the vacuum draw down line. Rupture disks 185 and 187 prevent over-pressurization of the lines. Test chamber 170 has two temperature sensors 189 and 191, and a pressure sensor 193.

Gaseous hydrogen enters the light gas gun chamber 171 through a check valve 195 and a pressure controlled NC quaternary supply chamber inlet valve 197 where the flow is controlled by gas applied through an open solenoid 199. For safety, valve 201 (opened by solenoid 203) acts as a vent for the closed chamber 171.

FIG. 9 is a legend corresponding to the lettering of the pipes and tubes in FIGS. 4-8. It shows the preferred construction of the lines used in the system.

Figure 10:
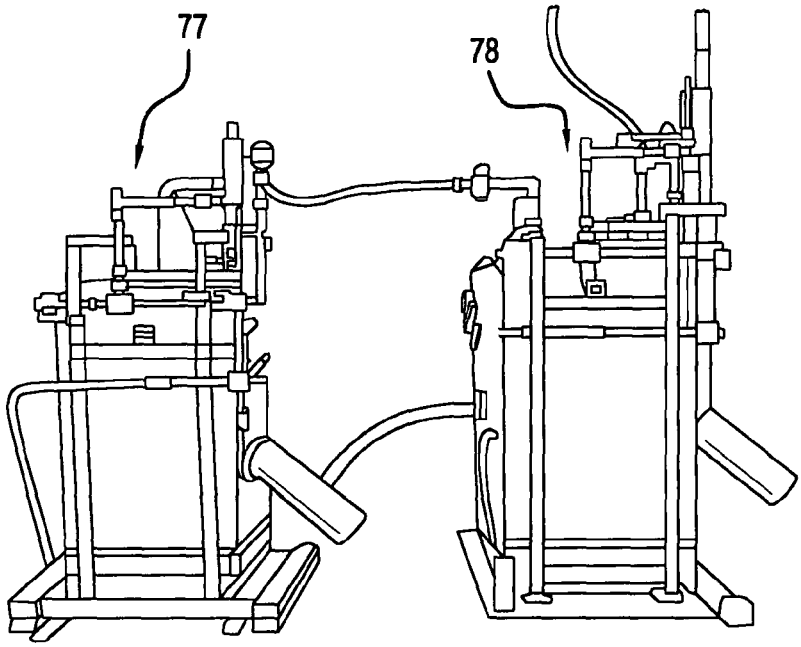
FIG. 10 is a photograph of hydrogen and oxygen pumps for charging accumulators.
Figure 11:
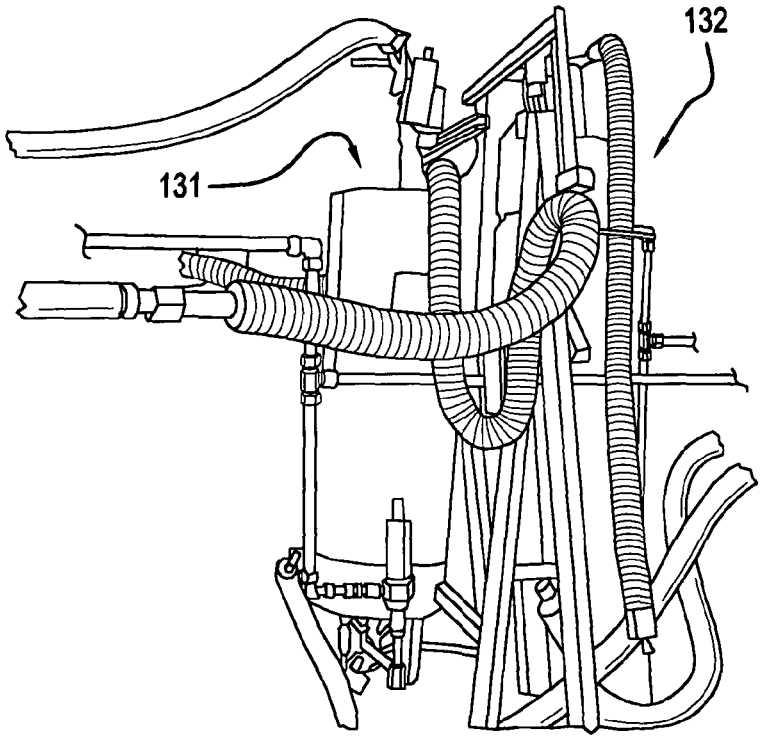
FIG. 11 is a photograph of the accumulators.

FIG. 10 is a photograph showing the hydrogen and oxygen pumps 77 and 78 used to charge the hydrogen and oxygen accumulators 131 and 132 (FIG. 11).

FIG. 11 shows the accumulators 131 and 132.

Figure 12:
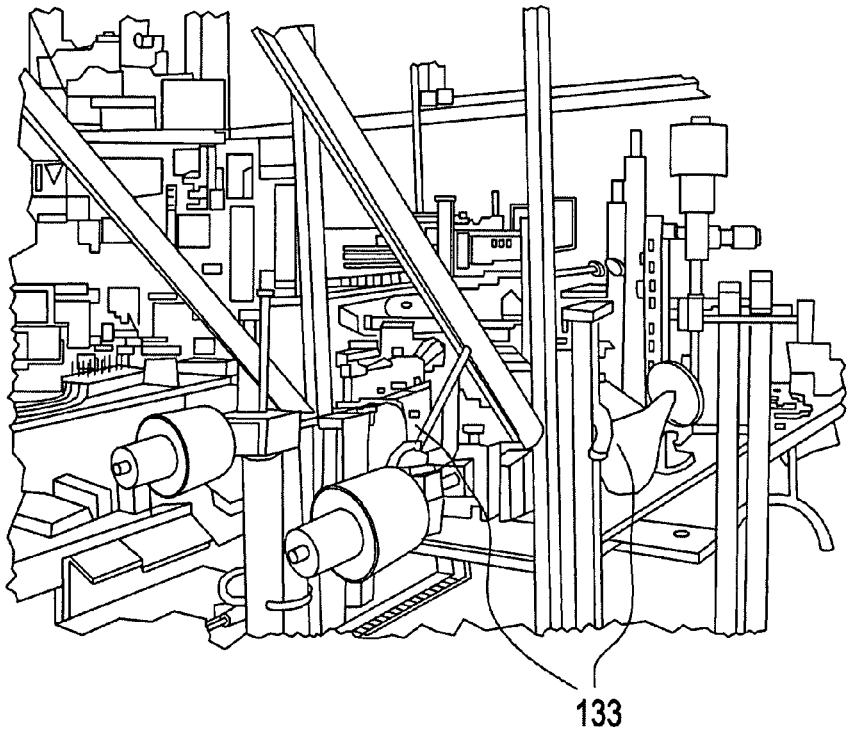
FIG. 12 is a photograph of the mass control system.

FIG. 12 shows the mass control system, consisting of a regulator 157 and mass flow meter 133.

Figure 13:
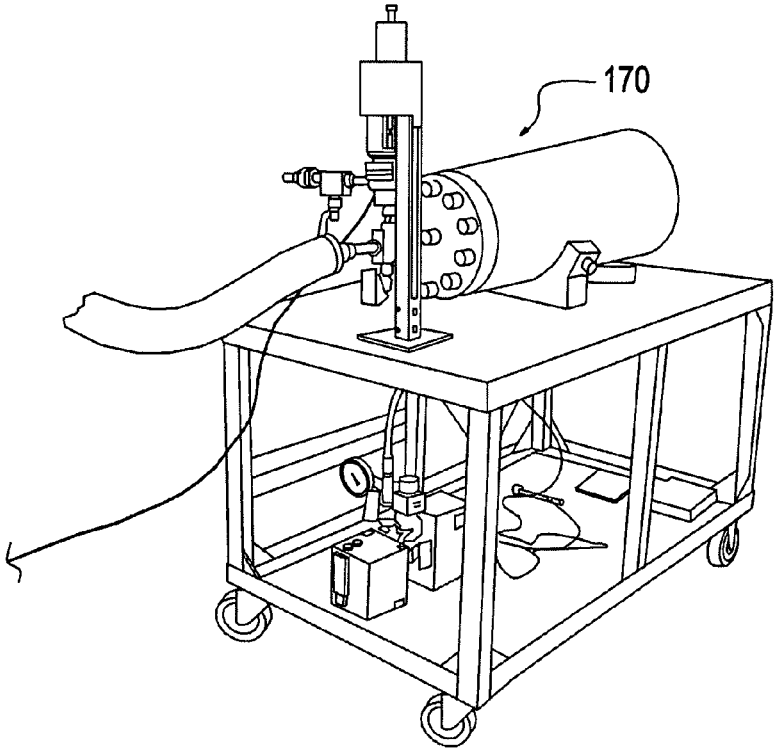
FIG. 13 is a photograph of the closed chamber.

FIG. 13 shows the closed chamber 170.

The present invention provides rapid, higher pressure, higher density, transient, and batch injection of cryogenic liquid or gas. In 0.5 to 3.0 seconds, this invention injects enough gas to provide 500 to 6500 psi pressure in a relatively small, closed combustion chamber. This invention provides steady state injection or transient injection. Prior art typically uses injection pressures ranging from 200 to 2000 psi with potential up to 3000 psi. This invention injects cryogenic liquids or gases at 500 to 6500 psi with potential for much higher pressures as cycle rates increase.

The injection system feeds hydrogen and oxygen from tanks, through subcoolers to pumps that charge accumulators to a pressure as high as 8000 psi, through a pressure-reducing regulator (500 to 6500 psi), through a mass flow meter and into a closed chamber. Large lines reduce the pressure drop from high transient flow rates to minimize injection time for a high cycling rate.

While the invention has been described with reference to specific embodiments, modifications and variations of the invention may be constructed without departing from the scope of the invention.

We claim:

1. A hydrogen injection system comprising:
- a liquid hydrogen source,
- a liquid hydrogen storage tank connected to the source,
- a liquid hydrogen transfer system connected to the tank that feeds liquid hydrogen from the storage tank to a liquid hydrogen pump,
- the liquid hydrogen pump connected to the liquid hydrogen transfer system,
- a liquid hydrogen outlet connected to the liquid hydrogen pump for moving liquid hydrogen from the liquid hydrogen pump,
- a hydrogen accumulator connected to the liquid hydrogen outlet,
- wherein the liquid hydrogen pump charges the hydrogen accumulator to a high pressure,
- a light gas gun closed combustion chamber connected to the hydrogen accumulator,
- wherein the hydrogen accumulator injects measured batches of hydrogen into the closed combustion chamber.

2. The injection system of claim 1, further comprising a mass flow meter connected to the hydrogen injector allowing precise control of the mass of high-pressure hydrogen provided by the hydrogen accumulator through the hydrogen injector into the closed combustion chamber.

3. The injection system of claim 1, wherein the hydrogen injector further comprises large fluid flow lines in the hydrogen injector reducing pressure drop and minimizing injection time for a high cycling rate.

4. The injection system of claim 1, wherein the hydrogen is at cryogenic temperatures.

5. The injection system of claim 1, wherein the hydrogen is rapidly injected into the closed chamber.

6. The injection system of claim 1, wherein the hydrogen is injected transiently for a period of less than three seconds at high liters per second rates.

7. The injection system of claim 1, wherein the hydrogen is injected at high pressures (500 psi to as high as 6,500 psi).

8. The injection system of claim 1, wherein the hydrogen accumulator provides high volume hydrogen storage at high pressure.

9. The injection system of claim 1, wherein the hydrogen accumulator comprises an inner liquid hydrogen tank with an outer liquid nitrogen tank, and wherein liquid nitrogen is supplied to the outer tank and nitrogen gas is exhausted from the outer tank for maintaining the temperature and pressure of the hydrogen gas in the inner tank.

10. The injection system of claim 1 further comprising a separate oxygen injection system comprising:
- a liquid oxygen source,
- a liquid oxygen storage tank connected to the source,
- a liquid oxygen transfer system connected to the tank that feeds liquid oxygen from the storage tank to a liquid oxygen pump,
- the liquid oxygen pump connected to the liquid oxygen transfer system,
- a liquid oxygen outlet connected to the liquid oxygen pump for moving liquid oxygen from the liquid oxygen pump,
- an oxygen accumulator connected to the liquid oxygen outlet,
- wherein the liquid oxygen pump charges the oxygen accumulator to a high pressure,
- an oxygen injector connected to the accumulator,
- wherein the light gas gun closed combustion chamber is connected to the oxygen injector,
- wherein the oxygen accumulator injects measured batches of oxygen into the closed combustion chamber.

11. The injection system of claim 10, wherein the oxygen accumulator comprises an inner liquid oxygen tank with an outer liquid nitrogen tank, and wherein liquid nitrogen is supplied to the outer tank and nitrogen gas is exhausted from the outer tank for maintaining the temperature and pressure of the oxygen liquid in the inner tank.

12. The injection system of claim 8, wherein the liquid hydrogen pump is a reciprocating pump and the hydrogen accumulator is charged by the pump.

13. A hydrogen injection system comprising:
- a source of a liquid substance,
- a liquid storage tank connected to the source,
- a liquid transfer system connected to the tank that feeds liquid from the storage tank to a pump,
- a liquid pump connected to the liquid transfer system,
- a liquid outlet connected to the pump for moving liquid from the pump,
- a liquid accumulator connected to the outlet,
- wherein the pump charges the accumulator to a high pressure,
- wherein the accumulator provides high volume storage at high pressure,
- wherein the accumulator comprises an inner liquid tank with an outer liquid tank and wherein liquid is supplied to the outer tank and gas is exhausted from the outer tank for maintaining the temperature and pressure of the liquid and gas in the inner tank,
- a mass flow meter connected to an injector allowing precise control of the mass of high-pressure liquid provided by the accumulator through the injector into a closed chamber of a light gas gun,
- wherein the injector further comprises large fluid flow lines in the injector reducing pressure drop and minimizing injection time for a high cycling rate,
- wherein the accumulator rapidly injects measured batches of liquid into the closed chamber,
- wherein the liquid is injected transiently for a period of 0.5 to 2.0 seconds at high liters per second rates,
- wherein the injection occurs at high pressures (500 psi to as high as 6,500 psi),
- wherein the substance is either liquid or dense, very cold hydrogen gas at cryogenic temperatures.

14. The method of injecting fuel and oxidant into a light gas gun chamber comprising:

separately providing sources of liquid hydrogen and liquid oxygen, separately storing the liquid hydrogen and liquid oxygen in storage tanks, surrounding the storage tanks with vacuum jackets, separately withdrawing liquids from the storage containers, moving the liquids through precoolers, separately transferring the liquids to inputs of separate steady state pumps, separately pumping the liquids from ambient pressures to elevated pressures up to 8000 psi, conducting the liquids under pressure to inner tanks of accumulators, maintaining liquid nitrogen in outer tanks of the accumulators, maintaining temperatures and pressures of the liquids in the inner tanks, and transiently or steadily injecting measured masses of the liquids into a closed combustion chamber of a light gas gun.

15. The injection system of claim 10, wherein the liquid oxygen pump is a reciprocating pump and the oxygen accumulator is charged by the liquid oxygen pump.

16. The injection system of claim 10, wherein the closed combustion chamber is the combustion chamber of a light gas gun and the system is able to fire the gun every 6 to 10 seconds and uses liquid storage of the oxygen and hydrogen.

17. The injection system of claim 10, wherein the accumulators fill the closed combustion chamber in 0.5 to 3 seconds.

* * * * *